US009518401B2

(12) United States Patent
Wang

(10) Patent No.: US 9,518,401 B2
(45) Date of Patent: Dec. 13, 2016

(54) OPEN WEB COMPOSITE SHEAR CONNECTOR CONSTRUCTION

(71) Applicant: Urbantech Consulting Engineering, PC, New York, NY (US)

(72) Inventor: Wei Wang, New York, NY (US)

(73) Assignee: URBANTECH CONSULTING ENGINEERING, PC, New York, NY (US)

( * ) Notice: Subject to any disclaimer, the term of this patent is extended or adjusted under 35 U.S.C. 154(b) by 0 days.

(21) Appl. No.: 14/526,009

(22) Filed: Oct. 28, 2014

(65) Prior Publication Data

US 2015/0167289 A1 Jun. 18, 2015

Related U.S. Application Data

(60) Provisional application No. 61/915,840, filed on Dec. 13, 2013.

(51) Int. Cl.

| | |
|---|---|
| ***E04H 9/02*** | (2006.01) |
| ***E04H 1/04*** | (2006.01) |
| ***E04B 5/04*** | (2006.01) |
| ***E04B 5/29*** | (2006.01) |
| ***E04B 5/38*** | (2006.01) |
| *E04B 1/24* | (2006.01) |

(52) U.S. Cl.

CPC ..... *E04H 9/02* (2013.01); *E04B 5/043* (2013.01); *E04B 5/29* (2013.01); *E04B 5/38* (2013.01); *E04H 1/04* (2013.01); *E04B 2001/2466* (2013.01); *E04B 2001/2484* (2013.01)

(58) Field of Classification Search

CPC .... E04B 1/24; E04B 2001/2484; E04B 5/043; E04B 2001/2448; E04B 5/04; E04B 5/29; E04B 5/43; E04B 2001/2415; E04B 1/1903; E04B 1/98; E04B 5/38; E04C 2003/0434; E04H 1/04; E04H 9/02

USPC ..... 52/327, 328, 334, 335, 340, 341, 351,52/414, 450, 289, 702

See application file for complete search history.

(56) References Cited

U.S. PATENT DOCUMENTS

| | | | | |
|---|---|---|---|---|
| 2,479,475 A * | 8/1949 | Cueni | E04B 5/29 | 52/334 |
| 3,845,594 A * | 11/1974 | Butts | E04B 5/29 | 52/334 |
| 3,930,348 A * | 1/1976 | Wise | E04C 5/0627 | 52/447 |
| 4,081,935 A | 4/1978 | Wise | | |
| 4,505,087 A | 3/1985 | Sarda | | |
| 4,653,237 A * | 3/1987 | Taft | 52/335 | |

(Continued)

*Primary Examiner* — Joshua J Michener
*Assistant Examiner* — Matthew Gitlin
(74) *Attorney, Agent, or Firm* — Troutman Sanders LLP

(57) ABSTRACT

A system for constructing multi-story building is disclosed. The system can include a plurality of vertical beams and a base beam section. The base beam section can be supported horizontally between the plurality of vertical column members and can include a composite shear connector attached thereto. The framing system can further include a plurality of concrete plank sections spanning perpendicularly to, and supported by, either side of the base beam. The plurality of concrete plank sections can be assembled in pairs. The framing system can also include grout material applied to the composite shear connector and the concrete plank sections to fill the cavities of the assembly to provide an integral framing system. A method for assembling such a system is also disclosed.

32 Claims, 10 Drawing Sheets

(56) References Cited

U.S. PATENT DOCUMENTS 4,700,519 A * 10/1987 Person ..... E04B 5/40 52/334
4,716,695 A * 1/1988 Alexander ..... E04B 1/164 52/167.3
4,729,201 A * 3/1988 Laurus et al. ..... 52/334
4,785,600 A * 11/1988 Ting ..... E04B 5/29 52/334
4,894,898 A 1/1990 Walker
5,113,631 A * 5/1992 diGirolamo et al. ..... 52/236.8
5,414,972 A * 5/1995 Ruiz ..... E04B 5/29 52/335
5,448,866 A * 9/1995 Saito ..... E04B 5/04 52/332
5,544,464 A * 8/1996 Dutil ..... 52/330
5,561,957 A * 10/1996 Gauthier ..... E04B 5/23 52/332
5,669,194 A * 9/1997 Colasanto ..... E04B 1/24 52/236.8
5,704,181 A * 1/1998 Fisher et al. ..... 52/438
5,887,405 A * 3/1999 Carranza-Aubry ..... 52/745.1
6,442,908 B1 9/2002 Naccarato
6,807,789 B1 * 10/2004 Kim ..... E01D 19/125 52/847
7,013,613 B1 * 3/2006 Boellner ..... E04B 5/29 52/692
7,562,500 B2 * 7/2009 Siu ..... 52/236.6
7,779,590 B2 * 8/2010 Hsu ..... E04B 5/40 52/328
8,028,493 B2 * 10/2011 Holmes et al. ..... 52/837
8,281,534 B2 * 10/2012 Bae ..... E04B 5/40 52/333
8,499,511 B2 * 8/2013 Platt et al. ..... 52/220.8
8,516,762 B1 * 8/2013 Jendusa ..... E04C 3/09 52/220.2
8,661,754 B2 * 3/2014 Hsu ..... E04B 5/40 52/289
8,707,644 B2 * 4/2014 Degen ..... E04B 1/6116 52/309.12
2010/0018151 A1 * 1/2010 Hiriyur ..... E04B 1/24 52/656.2
2014/0298745 A1 * 10/2014 Rechenmacher ..... E04C 3/02 52/425

* cited by examiner

OPEN WEB COMPOSITE SHEAR CONNECTOR CONSTRUCTION

CROSS-REFERENCE TO RELATED APPLICATIONS

This application claims the benefit of U.S. Provisional Patent Application Ser. No. 61/915,840, entitled "Open Web Composite Shear Connector Construction," filed on Dec. 13, 2013, which is incorporated herein by reference in its entirety as if fully set forth below.

TECHNICAL FIELD

Embodiments of the present technology relate to the construction of multi-story buildings, and more particularly to an improved structural framing system and associated method for construction of such buildings. The system comprises a composite concrete and steel assembly, which can incorporate one or more steel beams disposed between, and joined along, adjacent edges of precast concrete plank members such that the composite strength of the structure is substantially enhanced.

BACKGROUND OF RELATED ART

When constructing a multi-story building, the framing system is generally the load bearing structure that supports the building. Commercial framing, for example, typically consists of vertical steel beams with horizontal beams spanning between them. The floor of each story is typically a concrete slab that rests upon the horizontal beams of the framing structure. This floor slab can be steel reinforced concrete and can be attached to, or poured around, the framing beams. The framing system is designed to carry all of the anticipated floor and roof loads as well as provide stabilization against horizontal forces due to, for example, wind and seismic loads. The floor slab in particular is generally required to transmit such forces to building lateral systems, such as moment frames, braced frames, and shear walls, provided throughout the framing system in order to satisfy the minimum design requirement per building code.

In recent years, revisions to the national and international building code standards have increased lateral load requirements for seismic design criteria, especially the requirements for multi-story building construction. As a result, the framing systems of most prospective multi-story building structures will be required to resist lateral loads greater than those able to be accommodated by existing structural framework. Because of the increased seismic design criteria and the continuing pressure of minimizing construction costs, among other things, new design alternatives for structural framing systems have been developed to meet all current loading requirements imposed upon modern multi-story buildings in an economical and cost-effective manner. One of the recent developments in the field of building construction is to use prefabricated building components, such as precast concrete slab and wall panels, steel structures and other elements that can be manufactured in controlled environment. These precast concrete components are widely used in modern building construction. These prefabricated components can be easily erected and assembled in construction sites to greatly reduce the cost, fieldwork, and construction duration. U.S. Pat. No. 4,505,087, entitled "Method of construction of concrete decks with haunched supporting beams," discusses a method of construction of concrete decks utilizing precast members over which concrete is poured to form a monolithic structure. One problem associated with structures built from the precast concrete components is the overall integrity. U.S. Pat. No. 4,081,935 A, entitled "Building structure utilizing precast concrete elements," discusses a construction method for improving the structural integrity of such structures by applying cast concrete over the precast concrete slab panels and beams. However, there are other integrity problems left unanswered. For example, in some situations, structural steel and precast concrete members are desired to be used together in constructing a building. Currently, technologies for integrating these two types of materials are underdeveloped, which, as a result, inevitably hinders constructions based on these types of materials.

Another recent design alternative for a structural framing system is described in U.S. Pat. No. 6,442,908 wherein a dissymmetric steel beam having a narrowed, thickened top flange, a widened bottom flange, and a web having trapezoidal openings extending therebetween is adapted to be horizontally disposed between adjacent vertical steel columns that are erected upon conventional foundations. Standard hollow core sections of precast concrete plank are assembled together perpendicularly to the open web dissymmetric beam. The planks are supported by the bottom flange on either side, such that the open web of the beam is centrally disposed between end surfaces of the plank sections in substantially the same horizontal plane. A high-strength grout mixture applied to the assembled beam and plank sections is made to flow completely through the web openings in a circulatory manner thereby creating a substantially monolithic concrete encasement around the dissymmetric beam. This improves the resulting composite action and mechanical interlock between the steel beam and concrete plank and reduces loss of strength due to separation of the grout from either side of the beam.

While initial testing indicates that the framing system of the aforementioned patent has increased load bearing, testing has also indicated a need to enhance the composite action. In response, embodiments of the present technology relate to an open-web shear connector composite beam system, which combines some of the benefits of the conventional open-web castellated beam system and composite construction. In this configuration, the precast beams can act with steel beams, and can greatly increase the bending strength of the beams. The open web composite shear connectors can also act compositely with the base beam to further increase the bending strength of the system. Precast concrete planks and/or panels can be easily set on the steel beams with no interference from beam flanges during erection. The open-web of the composite shear connectors can enable the precast concrete deck to be integrated with the steel beam to provide required composite action. Reinforcement can be added and can provide, for example, additional shear strength, ductility, and toughness. Improved and increased ductility can greatly improve the seismic resistant characteristics of a structure. This improvement may be further enhanced if precast concrete filigree panels are utilized.

The system can be utilized for building within a wide range of span lengths. The system also provides a wide range of load capacities, which can enable the system to meet the demands of, for example and not limitation, residential, industrial, and commercial applications. The use of precast concrete panels can also reduce construction duration significantly. Precast panels can also minimize weather delays, since conditions such as humidity, precipitation, and temperature no longer affect the ability to pour and properly set concrete (i.e., the panels can be precast and cured in controlled conditions and then transported to the job site).

SUMMARY

Embodiments of the present technology are directed to a structural framing system for a multi-story building. The framing system can include a plurality of vertical column members. The system can also include a base beam section, supported horizontally between the plurality of vertical column members, and having a composite shear connector attached thereto. The framing system can further include a plurality of concrete plank sections and spanning perpendicularly to, and supported by, either side of the base beam. In some embodiments, the plurality of concrete plank sections can be assembled in pairs. In some embodiments, the framing system can also include grout material applied to, for example and not limitation, the composite shear connector and concrete plank sections to fill the cavities of the assembly and provide increased strength to the framing system.

One aspect of the present technology relates to a structural framing system for supporting a building. The system may include a plurality of vertical column members. The vertical column members may support a horizontal base section. A pair of concrete plank sections may be arranged in a linear fashion and disposed above and perpendicular to the base section. Each concrete plank section may define a passage therethrough. A composite shear connector may be disposed above the base section and between the pair of concrete plank sections. The shear connector may define an opening in communication with the passages of the concrete plank sections. A reinforcement bar may be disposed across the opening of the shear connector. The reinforcement bar may extend into the passages of the concrete plank sections. The shear connector and the concrete plank sections may define a cavity. An adhesive material may fill in the cavity.

Embodiments of the present technology can also be directed to a method of constructing a structural framing system. The method can include erecting a plurality of vertical columns and supporting a plurality of base beams horizontally therefrom with a plurality of the open web composite shear connectors. The method can also include installing a plurality of concrete plank sections and installed on either side of the base beam. In some embodiments, the plurality of concrete plank sections can be assembled in pairs. The method can additionally include applying a grout material to cavities between the plank sections and open web composite shear connectors to provide a mechanical connection therebetween.

One aspect of the present technology relates to a method for assembling a structural framing system. The method may include erecting a plurality of vertical column members. A horizontal base section may be secured to the plurality of vertical column members. A pair of concrete plank sections may be arranged in a linear fashion above and perpendicular to the base section. Each concrete plank section may define a passage therethrough. The method may include disposing a composite shear connector above the base section and between the pair of concrete plank sections. The shear connector may define an opening in communication with the passages of the concrete plank sections. A reinforcement bar may be disposed across the opening of the shear connector. The reinforcement bar may extend into the passages of the concrete plank sections. The shear connector and the concrete plank sections may define a cavity. The method may also include filling an adhesive material into the cavity.

These and other objects, features, and advantages of the present technology will become more apparent upon reading the following specification in conjunction with the accompanying drawings.

DETAILED DESCRIPTION

Figure 1A:
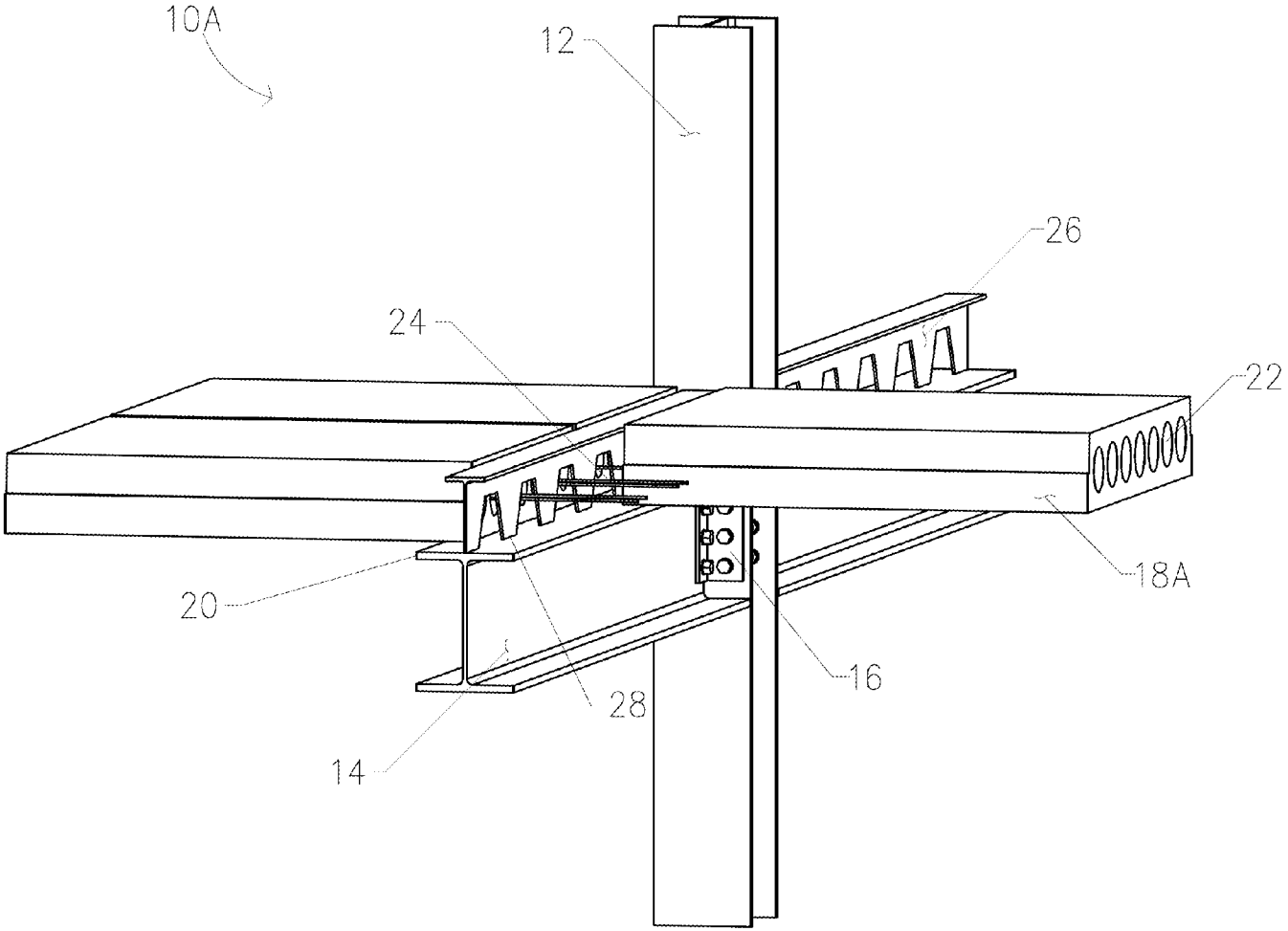
FIG. 1A and FIG. 1B are fragmentary perspective views of an assembled structural framing system, in accordance with some embodiments of the present disclosure.

An exemplary structural framing system 10A in accordance with some embodiments of the present technology is illustrated in FIG. 1A. Framing system 10A can comprise a vertical column 12 connected to a base beam 14. This connection can be made using, for example, a clip angle connector (sometimes also referred to as an angle web cleat or web bracket) 16. Web bracket 16 can be, for example, bolted, riveted, or welded to vertical column 12 and base beam 14. This connection can provide the vertical support for base beam 14 and all of the floor loads. This connection can also provide horizontal support for countering shear loads passed through the floor due to wind and the like.

Base beam 14 can be, for example and not limitation, a standard rolled steel beam section, plate, or a welded plate girder. Base beam 14 can have one or more channels. In some embodiments, base beam 14 can be a castellated or cellular beam. A series of precast concrete planks 18A can be laid down on top of a flange 20 of base beam 14. Based on the application, flange 20 of base beam 14 can be multiple shapes and sizes. In the case of a base beam 14 section that is a flat steel plate, for example, the flange 20 can be the upper surface of that plate.

Precast concrete planks 18A can be, for example, conventional pre-stressed concrete members. Of course, other types of planks are known in the art of building construction and are contemplated herein. In some embodiments, concrete planks 18A can have grooves or passages 22 (also known as hollow cores) formed therein to enable reinforcement bars 24, wiring, plumbing, and other components to pass through them. In some embodiments, the concrete planks 18A can be formed such that a pair of planks contains corresponding grooves that formed passages 22 when joined together. In other embodiments, concrete planks 18A can be cast with passages 22 running through a single plank.

Figure 6:
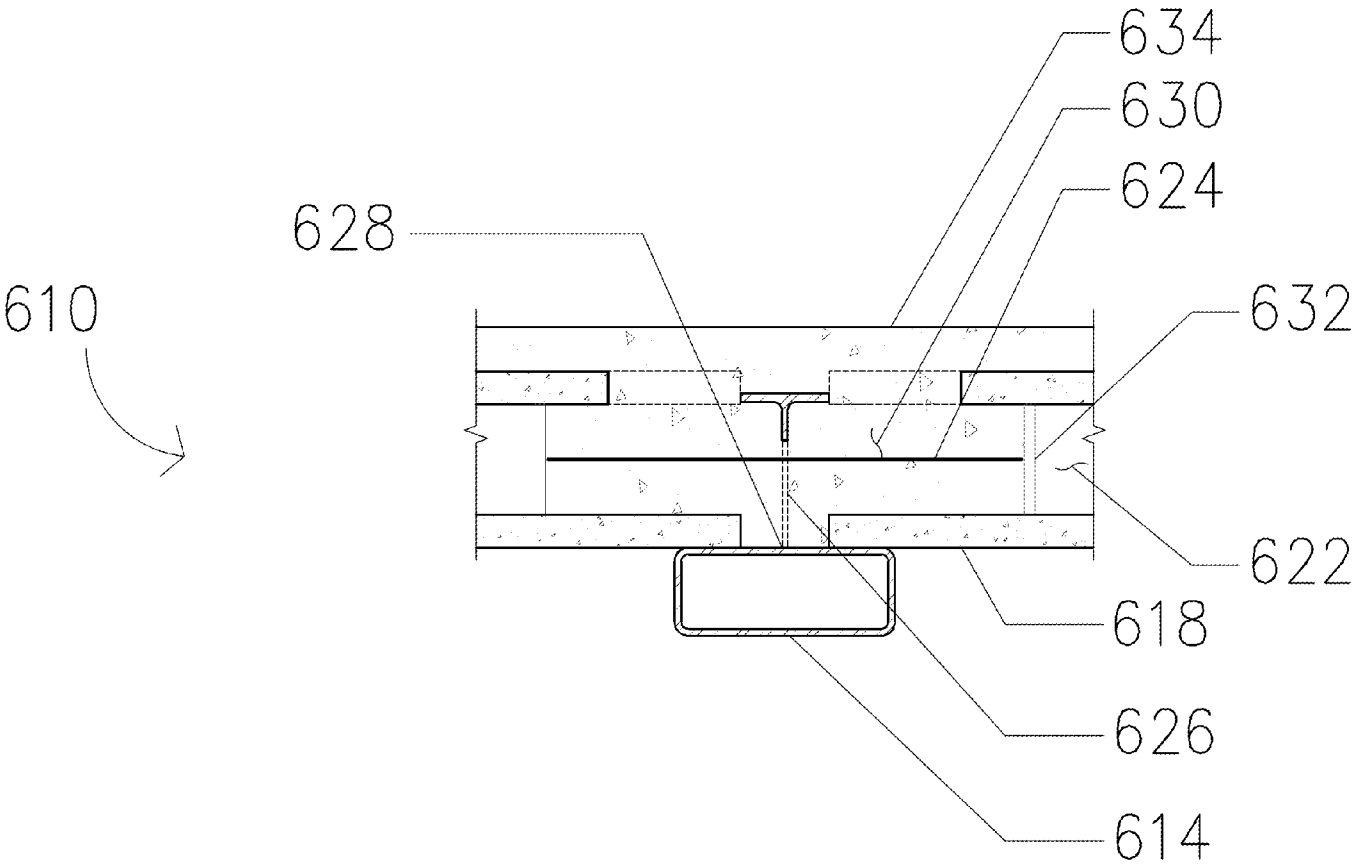
FIG. 6 is a cross-sectional view of a fifth embodiment of the assembled structural framing system of the present disclosure, in accordance with some embodiments of the present disclosure.

In some embodiments, a composite shear connector 26 can be included to provide additional structure to framing system 10A. In some embodiments, the open web composite shear connector 26 can be fabricated by taking an I-beam and cutting it in half according to a pattern such as illustrated in FIG. 6 and discussed below. In other embodiments, the composite shear connector 26 can be manufactured using other suitable methods including being fabricated from plate, cast, or CNC machined, among other methods known in the art. The composite shear connector 26 can be joined to base beam 14 at joint 28. Joint 28 can include many suitable methods known in the art of connecting two beams including, for example and not limitation, welding, riveting, or bolting.

Figure 1B:
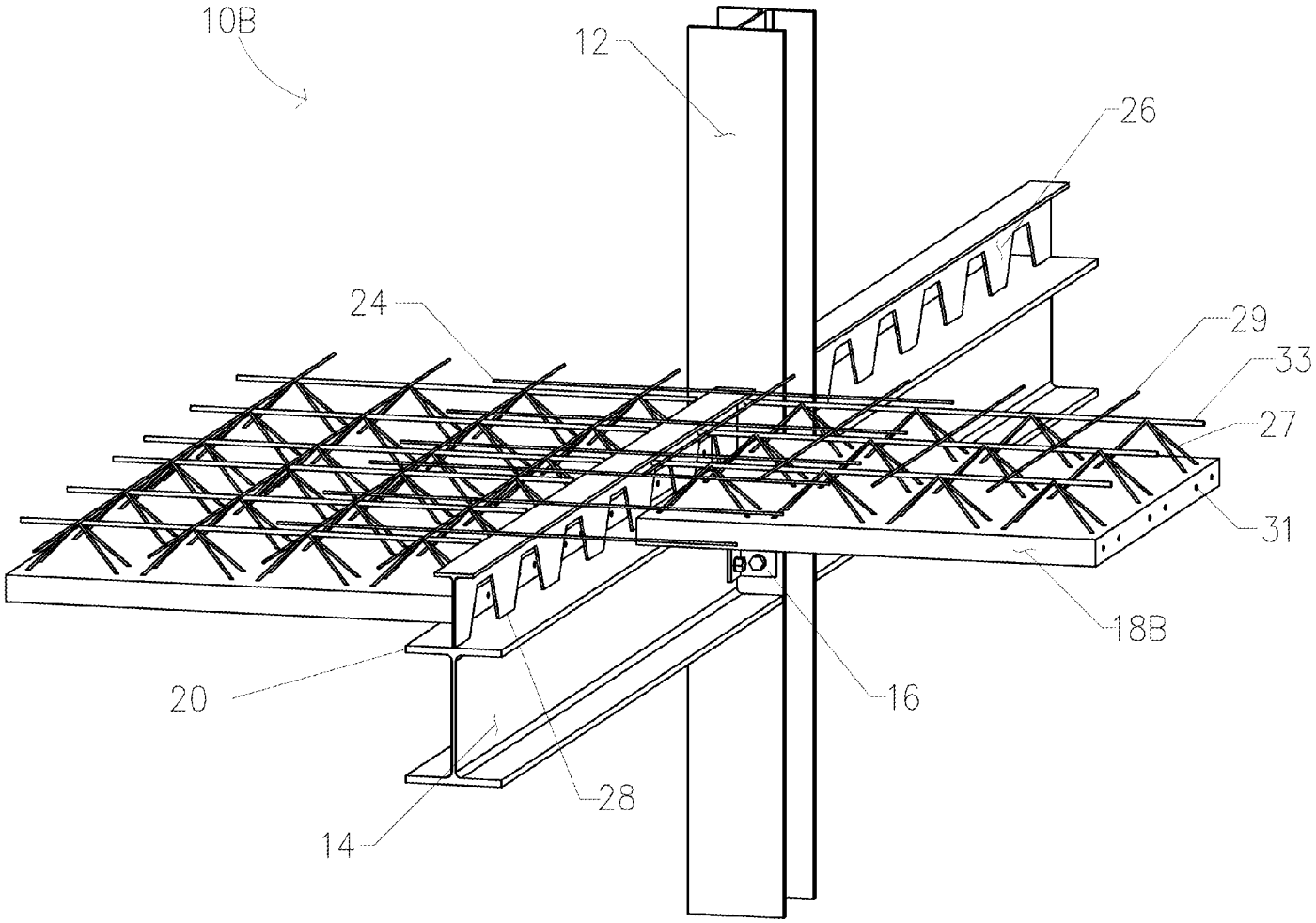

FIG. 1B illustrates framing system 10B. Similar to framing system 10A, framing system 10B can comprise a vertical column 12 connected to a base beam 14. Also similar to system 10A, a series of precast concrete planks 18B can be laid down on top of a flange 20 of base beam 14. Planks 18B may be pre-stressed concrete planks reinforced with reinforcement bar 31. Reinforcement bar filigree 27 may be placed on top of concrete planks 18B, and may be arrayed using parallel reinforcement bar 29, and perpendicular reinforcement bar 33. As in FIG. 1A, reinforcement bar 24 may run through the openings in shear connector 26, but alternatively or additionally, reinforcement bar 24 may run above shear connector 26.

Once the concrete planks 18A or 18B, reinforcement bar 24, and composite shear connector 26 are in place on base beam 14, a high strength grout or concrete can be applied over the concrete panels 18A or 18B. This material can fill the passages 22 and other voids in framing system 10A or 10B to form an integral, composite floor system 10A or 10B.

Figure 2A:
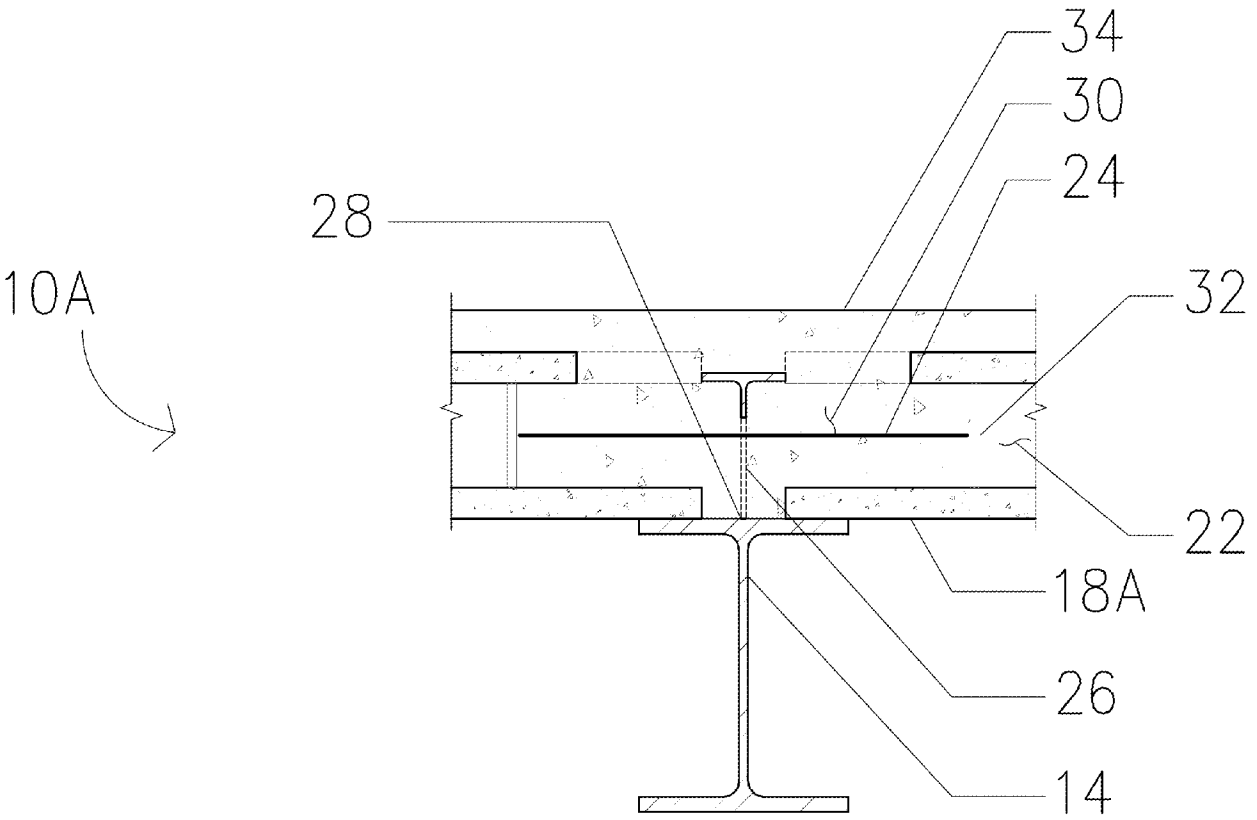
FIG. 2A and FIG. 2B are cross-sectional views of the assembled structural framing system of FIG. 1A and FIG. 1B, respectively, in accordance with some embodiments of the present disclosure.

FIG. 2A shows a cross-sectional view of the integrated structural framing system 10A of FIG. 1A. In some embodiments, cast-in-place concrete, hydraulic cement, or grout 30 can fill the voids in the system 10A and can encase the reinforcement bar 24 in passages 22. In some applications of the present disclosure, a dam 32 can be utilized to prevent concrete 30 from filling the entire passage 22 in concrete plank 18A. This can enable less concrete to be used in construction, thus saving time, weight, and material cost. Alternatively, the entirety of passage 22 can be filled.

Figure 2B:
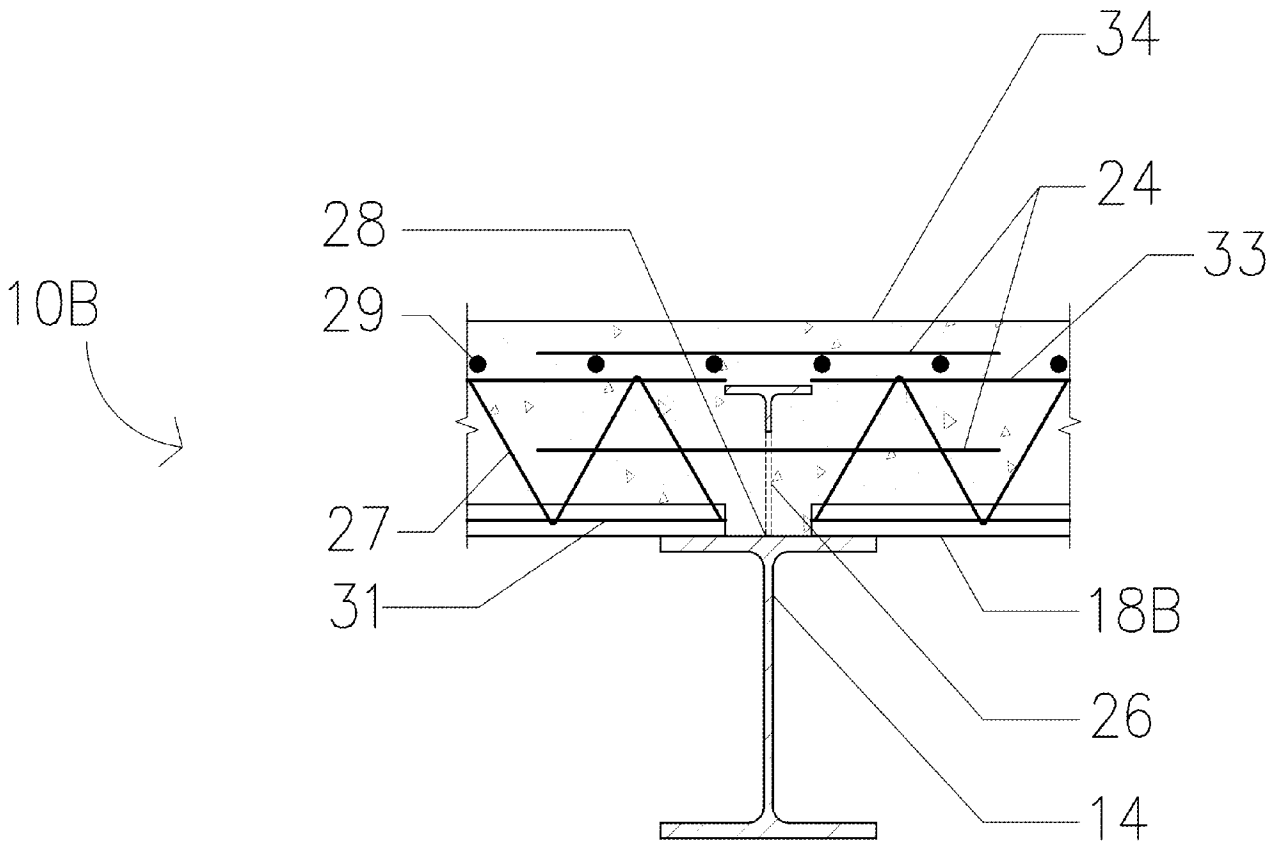

FIG. 2B shows a cross-sectional view of the integrated structural framing system 10B of FIG. 1B. In some embodiments, cast-in-place concrete, hydraulic cement, or grout can fill the voids in the system 10B and can encase the reinforcement bar 24, reinforcement bar filigree 27, parallel reinforcement bar 29, and perpendicular reinforcement bar 33. The resulting structure may be a unitary piece of concrete or the like, that is reinforced by the reinforcement bar 24, reinforcement bar filigree 27, parallel reinforcement bar 29, and/or perpendicular reinforcement bar 33 that it encases.

Once the concrete 30 has been poured to form an integrated system, a concrete overlay 34 can be poured or placed. Concrete overlay 34 can be used to provide a smooth surface on which to lay hardwood, carpet, or other flooring, or can simply be polished or textured for use as a flooring surface. In some embodiments, concrete overlay 34 can serve as both an overlay as well as grout 30. Concrete overlay 34 can increase the vertical and lateral strength of the flooring system, and improve the overall structural integrity of the building system.

Figure 3:
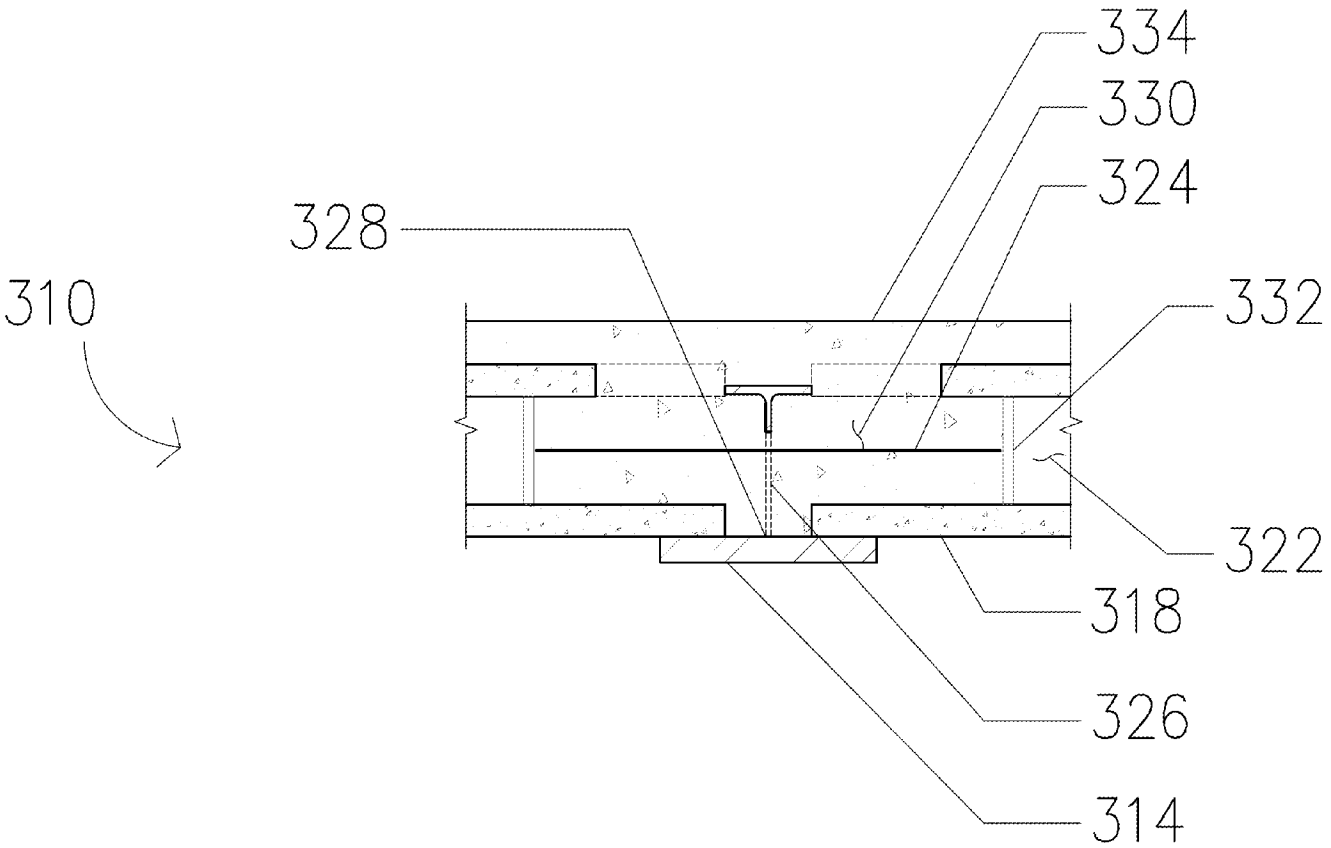
FIG. 3 is a cross-sectional view of a second embodiment of the assembled structural framing system, in accordance with some embodiments of the present disclosure.

FIG. 3 shows a cross-sectional view of a second embodiment of a structural framing system 310. In some embodiments, the base beam section 314 can be steel plate or the like. The rest of the construction can be similar to system 10A, with concrete planks 318, passages 322, reinforcement bar 324, concrete fill 330, dam 332, and concrete overlay 334. Joint 328 can be similar to the joint 28, discussed above, and used to connect shear connector 326 to steel plate 314.

Figure 4:
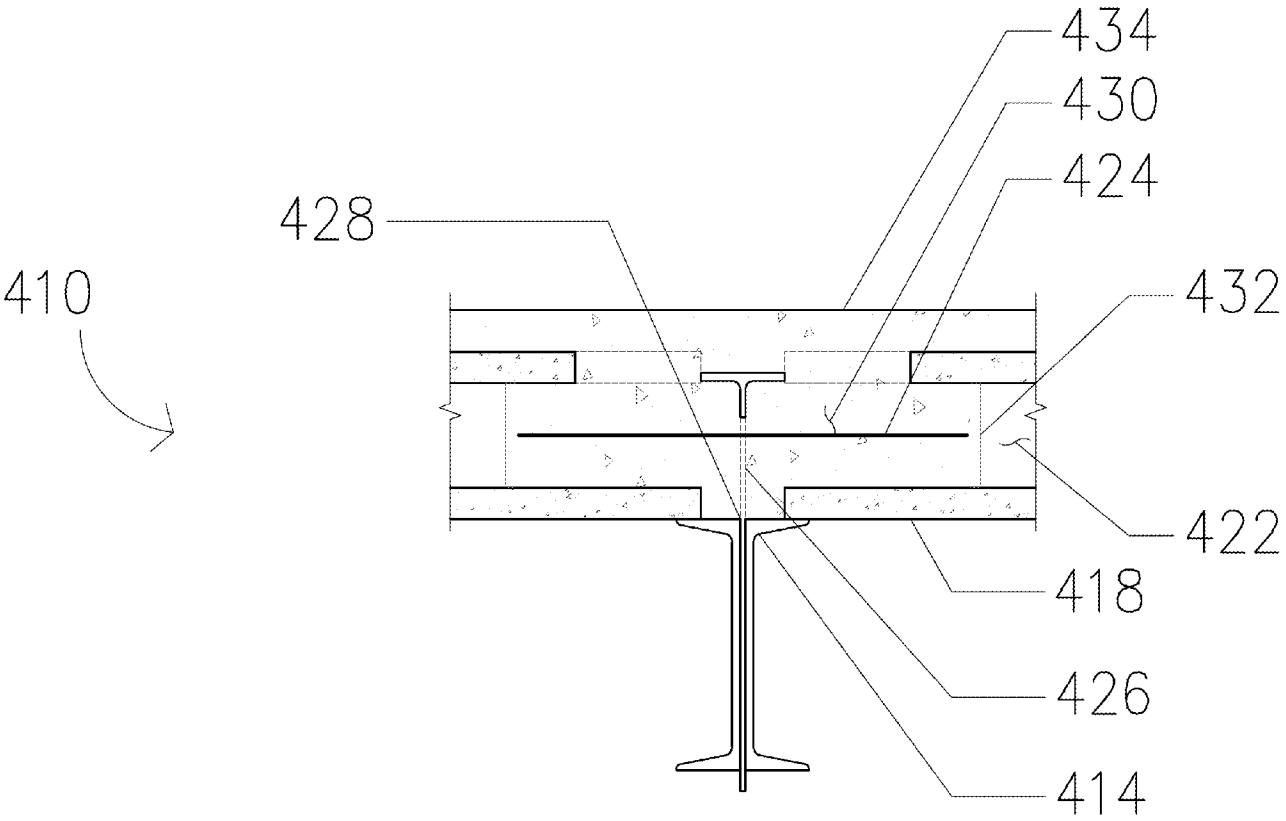
FIG. 4 is a cross-sectional view of a third embodiment of the assembled structural framing system of the present disclosure, in accordance with some embodiments of the present disclosure.

FIG. 4 shows a cross-sectional view of a third embodiment of a structural framing system 410. In some embodiments, the base beam section 414 can comprise one or more steel channels, which can be welded, or otherwise joined, to either side of shear connector 426. In this configuration, the rest of the construction can be similar to system 10A, with concrete planks 418, passages 422, reinforcement bar 424, concrete fill 430, dam 432, and concrete overlay 434. Joint 428 can be similar to the joint 28, discussed above, and used to connect shear connector 426 to beam section 414.

Figure 5:
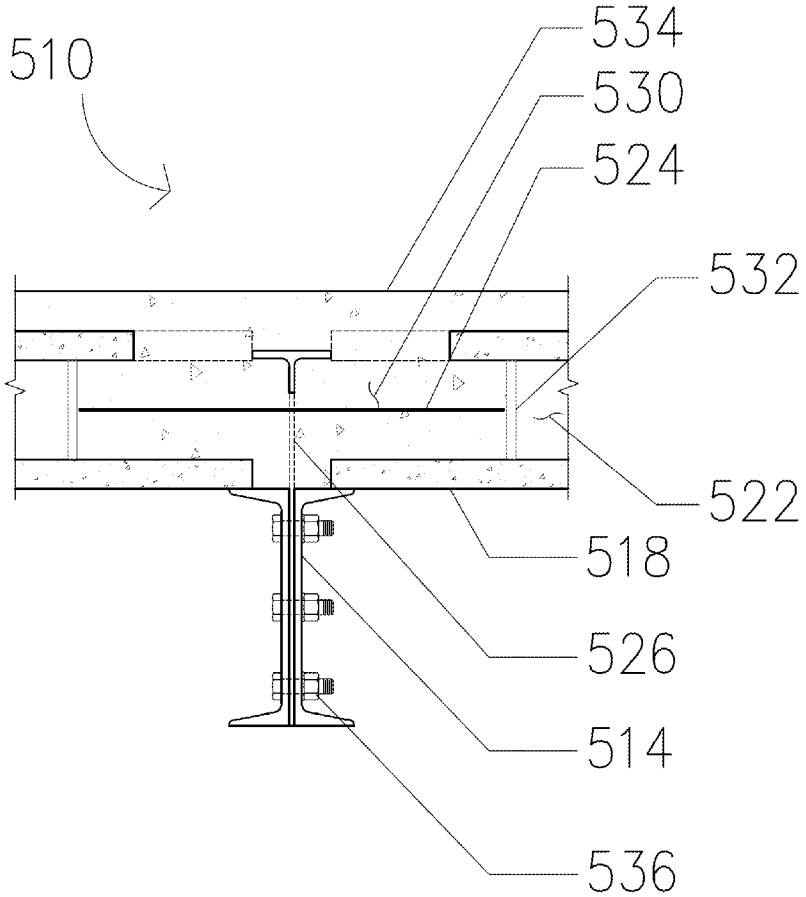
FIG. 5 is a cross-sectional view of a fourth embodiment of the assembled structural framing system of the present disclosure, in accordance with some embodiments of the present disclosure.

FIG. 5 shows a cross-sectional view of a fourth embodiment of a structural framing system 510. In this configuration, the base beam section 514 can comprise one or more steel channels bolted to either side of shear connector 526 with bolts 536, rivets, welds, or otherwise suitably joined. The rest of the construction can be similar to system 10A, with concrete planks 518, passages 522, reinforcement bar 524, concrete fill 530, dam 532, and concrete overlay 534.

FIG. 6 shows a cross-sectional view of a fifth embodiment of a structural framing system 610. In some embodiments, the base beam section 614 can comprise one or more steel tubes, which can be welded, or otherwise joined, to either side of shear connector 626. In this configuration, the rest of the construction can be similar to system 10A, with concrete planks 618, passages 622, reinforcement bar 624, concrete fill 630, dam 632, and concrete overlay 634. Joint 628 can be similar to the joint 28, discussed above, and used to connect shear connector 626 to steel plate 614. Base beam 614 can be used, for example, to resist torsion in applications requiring additional stiffness without a corresponding increase in mass (e.g., for particularly long floor spans).

Figure 7:
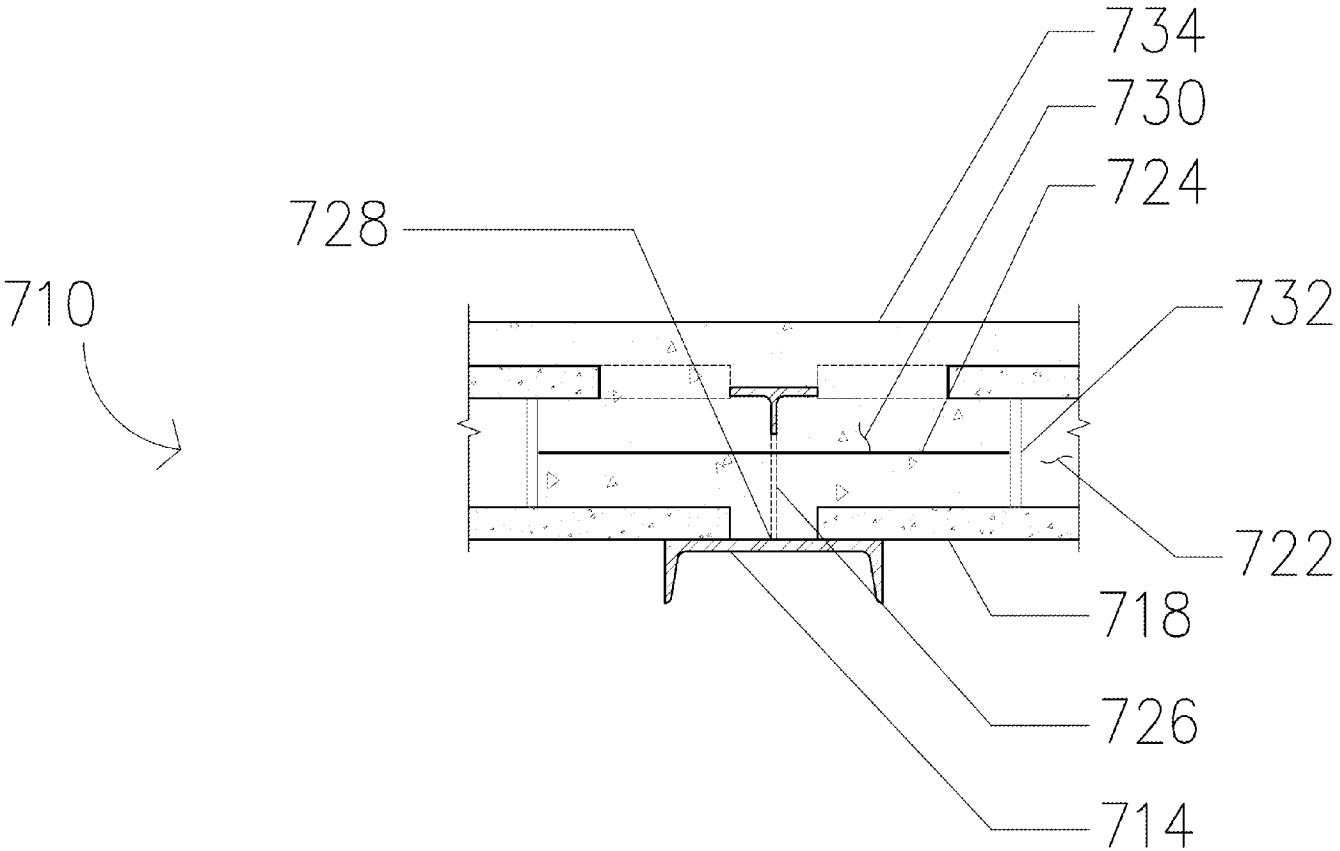
FIG. 7 is a cross-sectional view of a sixth embodiment of the assembled structural framing system of the present disclosure, in accordance with some embodiments of the present disclosure.

Similarly, FIG. 7 shows a cross-sectional view of a sixth embodiment of a structural framing system 710. In some embodiments, the base beam section 714 can comprise a steel channel positioned horizontally, which can be welded, or otherwise joined, to either side of shear connector 726. In this configuration, the rest of the construction can be similar to system 10A, with concrete planks 718, passages 722, and concrete fill 730.

Figure 8:
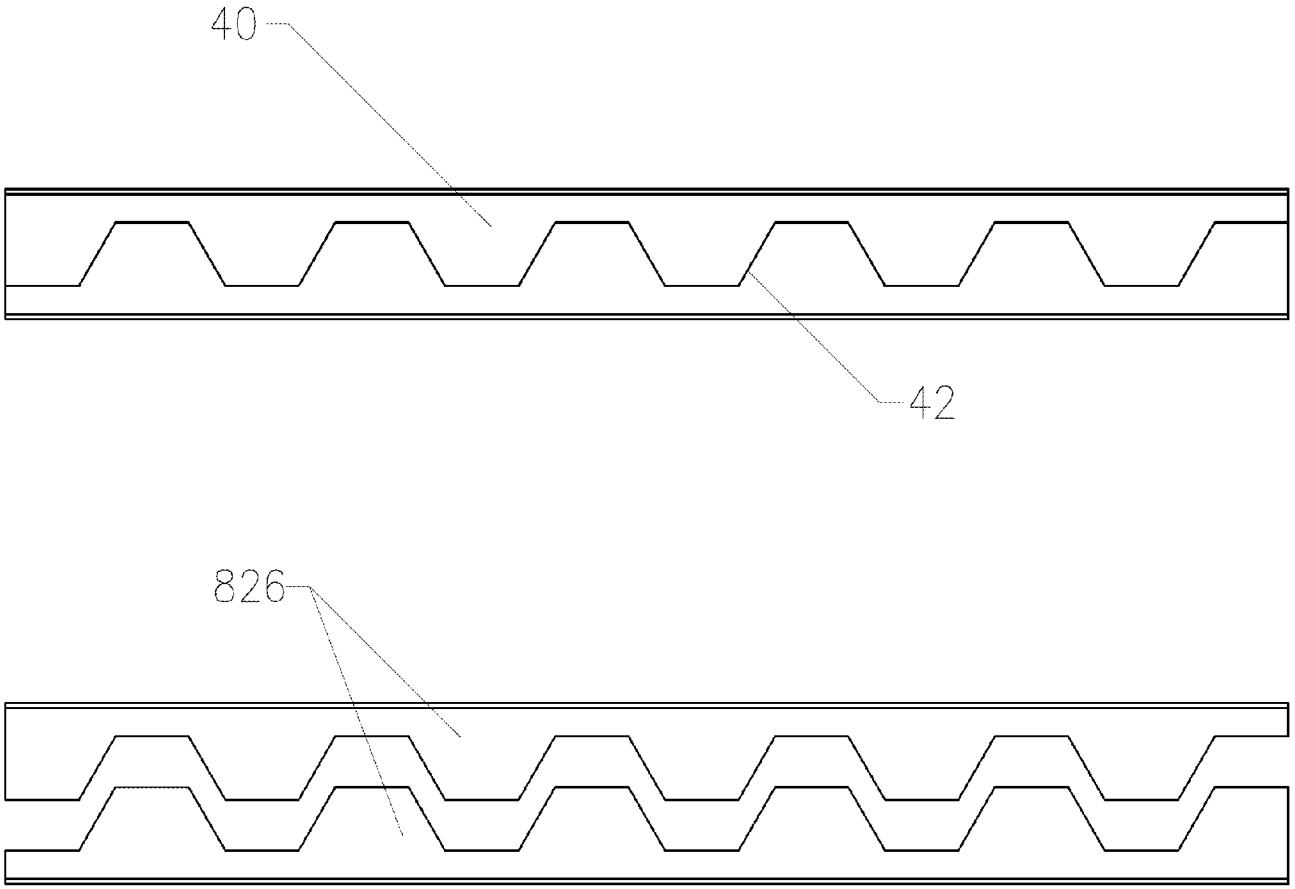
FIG. 8 is a diagrammatic representation of a continuous cutting pattern employed to obtain an exemplary open-web composite shear connector, in accordance with some embodiments of the present disclosure.

An exemplary cutting pattern for manufacturing an open web composite shear connector 826 is illustrated in FIG. 8. Connector beam 40 can be, for example, a wide flange section, I-section, S-section, channel, or other shape of beam. In some embodiments, the beam 40 can be cut along cut line 42 to form two composite shear connectors 826. It is contemplated that if cut line 42 is chosen to generate substantially symmetrical shear connectors 826, then the resulting pieces can be used along the same base beam. However it is further contemplated that cut line 42 can result in asymmetrical shear connectors 826 to meet different load or design requirements. In this configuration, the resulting pieces can be used, for example, on different parts of a building's construction or, for example, on different buildings to minimize material waste.

It will be apparent to those skilled in the art that various modifications and variations can be made to the structural framing system of the present disclosure without departing from the scope of the disclosure. For example, the system is described above as being welded, bolted, or riveted together. One skilled in the art will realize, however, that other suitable methods of joining components exist. Other embodiments will be apparent to those skilled in the art from consideration of the specification and practice of the building system disclosed herein. It is intended that the specification and examples be considered as exemplary only, with a true scope of the invention being indicated by claims, and their equivalents, in subsequent, related non-provisional patent applications.

What is claimed is:

1. A structural framing system for supporting a building, comprising:

a plurality of vertical column members;

a horizontal base beam supported by the plurality of vertical column members, the beam including a top flange, a bottom flange and at least one vertical wall between the top flange and the bottom flange, the at least one vertical wall being secured to at least one of the vertical column members by a connection member;

a pair of concrete plank sections arranged in a linear fashion disposed above and perpendicular to the base beam, each concrete plank section defining a width wherein said concrete plank sections are supported directly on the top flange of the horizontal base beam;

an open web composite shear connector disposed above the base beam and between the pair of concrete plank sections, the shear connector defining a length at least equal to the width of each concrete plank section; and an adhesive material filling in a cavity defined by the shear connector and the concrete plank sections.

2. The system of claim 1, wherein the building is a multi-story building.

3. The system of claim 1, wherein the base beam includes a steel beam, a steel plate, a welded plate girder, a castellated beam, or a cellular beam.

4. The system of claim 1, wherein the base beam includes at least one steel channel.

5. The system of claim 4, wherein the steel channel is connected to the shear connector by bolting, riveting, welding, or joining.

6. The system of claim 1, wherein the base beam includes at least one steel tube.

7. The system of claim 6, wherein the steel tube is connected to the shear connector by welding or joining.

8. The system of claim 1, wherein at least one of the concrete plank sections includes a pre-stressed concrete member.

9. The system of claim 1, wherein the shear connector includes at least a portion of a wide flange section, I-section, S-section, or channel.

10. The system of claim 1, wherein the shear connector is configured to act compositely with the base beam.

11. The system of claim 1, wherein the shear connector is joined to the base beam by welding, riveting or bolting.

12. The system of claim 1, further comprising a reinforcement bar filigree placed on top of the concrete plank sections.

13. The system of claim 12, wherein the reinforcement bar filigree includes a plurality of parallel reinforcement bars and perpendicular reinforcement bars.

14. The system of claim 1, further comprising a dam in at least one of the concrete plank sections.

15. The system of claim 1, wherein the adhesive material includes a high strength grout, concrete, or hydraulic cement.

16. The system of claim 1, further comprising an overlay disposed above the concrete plank sections.

17. A method for assembling a structural framing system for supporting a building, comprising:

erecting a plurality of vertical column members;

securing a horizontal base beam to the plurality of vertical column members, the beam including a top flange, a bottom flange and at least one vertical wall between the top flange and the bottom flange, the at least one vertical wall being secured to at least one of the vertical column members by a connection member;

arranging a pair of concrete plank sections in a linear fashion above and perpendicular to the base beam, each concrete plank section defining a width, wherein said concrete plank sections are supported directly on the top flange of the horizontal base beam;

disposing an open web composite shear connector above the base beam and between the pair of concrete plank sections, the shear connector defining a length at least equal to the width of each concrete plank section; and filling an adhesive material into a cavity defined by the shear connector and the concrete plank sections.

18. The method of claim 17, wherein the building is a multi-story building.

19. The method of claim 17, wherein the base beam includes a steel beam, a steel plate, a welded plate girder, a castellated beam, or a cellular beam.

20. The method of claim 17, wherein the base beam includes at least one steel channel.

21. The method of claim 20, further comprising connecting the steel channel to the shear connector by bolting, riveting, welding, or joining.

22. The method of claim 17, wherein the base beam includes at least one steel tube.

23. The method of claim 22, further comprising connecting the steel tube to the shear connector by welding or joining.

24. The method of claim 17, wherein at least one of the concrete plank sections includes a conventional pre-stressed concrete member.

25. The method of claim 17, wherein the shear connector includes at least a portion of a wide flange section, I-section, S-section, or channel.

26. The method of claim 17, wherein the shear connector is configured to act compositely with the base beam.

27. The method of claim 17, further comprising joining the shear connector to the base beam by welding, riveting or bolting.

28. The method of claim 17, further comprising placing a reinforcement bar filigree on top of the concrete plank sections.

29. The method of claim 28, wherein the reinforcement bar filigree includes a plurality of parallel reinforcement bars and perpendicular reinforcement bars.

30. The method of claim 17, further comprising arranging a dam in at least one of the concrete plank sections.

31. The method of claim 17, wherein the adhesive material includes a high strength grout, concrete, or hydraulic cement.

32. The method of claim 17, further comprising disposing an overlay above the concrete plank sections.

* * * * *